US009139211B2

(12) United States Patent
Lude et al.

(10) Patent No.: US 9,139,211 B2
(45) Date of Patent: Sep. 22, 2015

(54) DEVICE FOR DETECTING THE OCCUPIED OR AVAILABLE STATUS OF A TRACK SEGMENT AND METHOD FOR OPERATING SUCH A DEVICE

(75) Inventors: Gerald Lude, Berlin (DE); Frank Plenzdorf, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/008,070

(22) PCT Filed: Mar. 20, 2012

(86) PCT No.: PCT/EP2012/054918

§ 371 (c)(1),
(2), (4) Date: Sep. 27, 2013

(87) PCT Pub. No.: WO2012/130667

PCT Pub. Date: Oct. 4, 2012

(65) Prior Publication Data

US 2014/0014783 A1 Jan. 16, 2014

(30) Foreign Application Priority Data

Mar. 31, 2011 (DE) ..... 10 2011 006 552

(51) Int. Cl.
*B61L 27/00* (2006.01)
*B61L 1/18* (2006.01)

(52) U.S. Cl.
CPC ..... *B61L 27/0038* (2013.01); *B61L 1/187* (2013.01); *B61L 1/188* (2013.01)

(58) Field of Classification Search
CPC ..... B61L 25/02; B61L 25/025; B61L 25/026; B61L 27/0038; B61L 1/187; B61L 1/188; B61L 1/18; B61L 1/14; B61L 1/20; B61L 1/00; B61L 3/00; B61L 3/24; B61L 3/008; B61L 23/24
USPC ..... 246/122 R, 123, 167 R, 473 R, 20, 34 R
See application file for complete search history.

(56) References Cited

U.S. PATENT DOCUMENTS 3,927,851 A * 12/1975 Wilcox ..... 246/37
4,136,315 A * 1/1979 Kuhn ..... 331/46

(Continued)

FOREIGN PATENT DOCUMENTS

DE 9307718 U1 7/1993
DE 9307918 U1 9/1993

(Continued)

OTHER PUBLICATIONS

"FTG S—Track Vacancy Detection with the FTG S Audio-frequency Track Circuit" by Siemens.

*Primary Examiner* — Jason C Smith
(74) *Attorney, Agent, or Firm* — Laurence A. Greenberg; Werner H. Stemer; Ralph E. Locher

(57) ABSTRACT

A device for detecting an occupied or available status of a track segment has a transmitter for feeding in a transmitted signal into the travel rails of the track segment and at least one receiver for receiving a received signal generated by transmitting the transmitted signal via the travel rails of the track segment. In order to simplify commissioning, the device is implemented for varying the frequency of the transmitted signal, for determining a resonant frequency of the transmitted signal, and for adjusting the frequency of the transmitted signal to the determined resonant frequency. A method for operating the device for detecting the occupied or available status of a rail segment is further discussed.

10 Claims, 1 Drawing Sheet

(56) References Cited

U.S. PATENT DOCUMENTS

| | | | | |
|---|---|---|---|---|
| 4,878,638 | A * | 11/1989 | Hoelscher et al. | 246/34 CT |
| 5,330,134 | A * | 7/1994 | Ehrlich | 246/34 R |
| 8,469,318 | B2 * | 6/2013 | Kaluscha | 246/122 R |
| 8,505,855 | B2 * | 8/2013 | Kikuchi et al. | 246/122 A |
| 2009/0277998 | A1 * | 11/2009 | Kiss et al. | 246/122 R |
| 2011/0127388 | A1 * | 6/2011 | Kaluscha | 246/122 R |
| 2011/0174934 | A1 * | 7/2011 | Kikuchi et al. | 246/122 R |
| 2011/0309204 | A1 * | 12/2011 | Bohlmann et al. | 246/122 R |
| 2011/0315828 | A1 * | 12/2011 | Bohlmann et al. | 246/167 R |
| 2012/0153089 | A1 * | 6/2012 | Galm et al. | 246/122 R |
| 2012/0181390 | A1 * | 7/2012 | Ashraf et al. | 246/122 R |
| 2013/0062474 | A1 * | 3/2013 | Baldwin et al. | 246/122 R |
| 2013/0240677 | A1 * | 9/2013 | Mesquita et al. | 246/122 R |
| 2013/0248658 | A1 * | 9/2013 | Takagi | 246/122 R |
| 2014/0014783 | A1 * | 1/2014 | Lude et al. | 246/122 R |
| 2014/0054424 | A1 * | 2/2014 | Xu et al. | 246/122 R |

FOREIGN PATENT DOCUMENTS

| | | | |
|---|---|---|---|
| DE | 102009010906 | A1 | 9/2010 |
| DE | 102009010907 | A1 | 9/2010 |
| GB | 2199975 | A | 7/1988 |

* cited by examiner

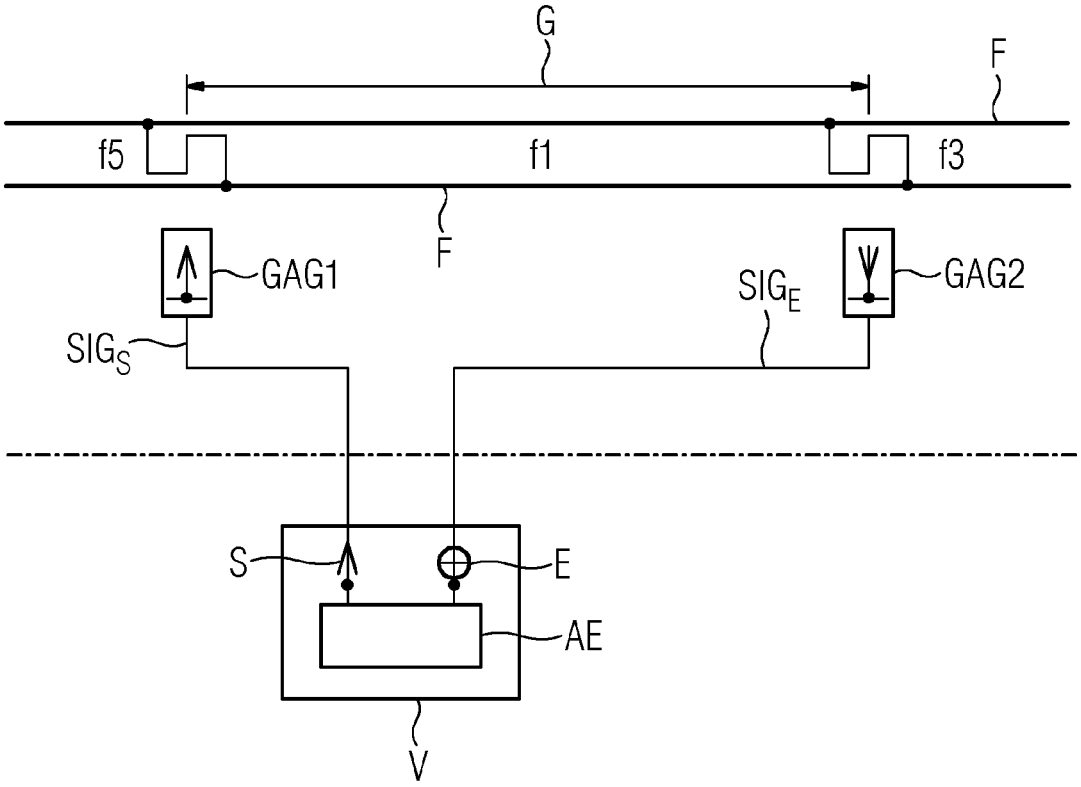
G
F
f5
f1
f3
F
GAG1
GAG2
SIG$_E$
SIG$_S$
S
E
AE
V

DEVICE FOR DETECTING THE OCCUPIED OR AVAILABLE STATUS OF A TRACK SEGMENT AND METHOD FOR OPERATING SUCH A DEVICE

BACKGROUND OF THE INVENTION

Field of the Invention

The present invention relates to a device for detecting the occupied or clear state of a track section, comprising a transmitter for feeding an outgoing signal into the running rails of the track section and at least one receiver for receiving an incoming signal produced by transmitting the outgoing signal is the running rails of the track section.

Such a device is known, for example, from the Siemens AG publication "FTG S—Track Vacancy Detection with the FTG S Audio-Frequency Track Circuit", order no. A19100-V100-B607-V2, in connection with a track vacancy detection system implemented as a track circuit. Here a transmitter feeds an outgoing signal in the form of an AC voltage into the running rails of a track section to be monitored. A receiver receives an incoming signal in the form of the incoming voltage and analyzes the incoming signal. Due to the fact that a rail vehicle running over the track section causes a short circuit between the running rails of the track section through its axles, the outgoing signal is prevented from reaching the receiver, thus making it possible to detect the occupied state of the track section in question.

In order to be able to feed the outgoing signal into the particular track section with as low resistance as possible and therefore with maximum efficiency, tuning to a resonance frequency is usually performed as part of system commissioning in known track vacancy detection systems in the form of corresponding audio-frequency track circuits. A suitable circuit for resonance tuning of the input and/or output resonant circuits of track circuits is known from the German utility model document DE 9307918 U1. In the case of the known circuit, resonance tuning is carried out by varying the capacitance of a capacitor.

With the known circuit, appropriate resonance tuning is performed manually for each individual track section. The reason for this is that the total inductance of the respective resonant circuit also depends in particular on the inductance of the rails of the respective track section. In practice, this makes the commissioning of track vacancy detection systems extremely time-consuming and costly.

BRIEF SUMMARY OF THE INVENTION

The object of the present invention is to specify a device of the type mentioned in the introduction for detecting the occupied or clear state of the track section and which allows commissioning to be simplified.

This object is achieved according to the invention by a device for detecting the occupied or clear state of a track section, having a transmitter for feeding an outgoing signal into the running rails of the track section and at least one receiver for receiving an incoming signal produced by transmitting the outgoing signal is the running rails of the track section, wherein the device is designed to vary the frequency of the outgoing signal, to determine a resonance frequency of the outgoing signal and to set the frequency of the outgoing signal to the resonance frequency determined.

For the device according to the invention it is therefore unnecessary to tune the system to a fixed resonance frequency. Instead, the frequency of the outgoing signal for operating the device, i.e. the working frequency, is selected such that it corresponds to a resonance frequency of the outgoing signal specifically for the respective track section. For this purpose the device according to the invention is advantageously designed such that it varies the frequency of the outgoing signal, determines a resonance frequency of the outgoing signal on the basis of the variation of the frequency of the outgoing signal, and then adjusts the frequency of the outgoing signal to the resonance frequency determined. Here automatic resonance tuning, i.e. automatic matching of the frequency of the outgoing signal to the respective resonance frequency, is advantageously possible, so that advantageously no tuning operations are required in the area of the outdoor equipment. The tuning process can inventively take place e.g. in a software-based manner using a control loop.

The device according to the invention has considerable advantages in terms of the time required and associated costs for commissioning the device for detecting the occupied or clear state of a track section. Moreover, considerable additional savings result from being able to dispense with expensive components for manually adjusting the frequency to the resonance frequency. In addition, there is advantageously no need for any special calibration equipment for resonance tuning, e.g. in the form of comparatively costly frequency-selective RMS instruments.

To prevent interference from adjacent track circuits, known devices for detecting the occupied or clear state of a track section can usually be matched to different operating frequencies by configuration. Thus known track circuits operate, for example, in the frequency range between 9.5 and 16.5 kHz, the different operating frequencies each having a spacing of 1 kHz.

The device according to the invention can advantageously be further developed such that the device can be matched, by configuration, to different operating frequencies and is designed to vary the frequency of the outgoing signal in the range of the respective configured operating frequency. This makes it possible, by configuration—with comparatively little time and effort—to initially specify an operating frequency of 12.5 kHz, for example. Varying the frequency of the outgoing signal within the range of the configured operating frequency consequently allows the resonance frequency resulting from the respective conditions to be determined and this to be set as the frequency of the outgoing signal. Starting from the operating frequency of 12.5 kHz preset by configuration in this example, it is conceivable for the frequency of the outgoing signal to be varied within a range of +/−100 Hz around this configured operating frequency and in this case a resonance frequency of 12.43 kHz to be determined in respect of the track circuit in question. This resonance frequency is therefore set, on the part of the device, as the outgoing frequency, i.e. the working frequency used during regular operation of the device.

According to another particularly preferred embodiment, the device can be matched, by configuration, to different operating frequencies by means of replaceable tuning units disposed in trackside connection boxes. The advantage of this is that matching to different operating frequencies merely necessitates selecting the appropriate tuning units, thereby minimizing the time and cost involved.

According to another particularly preferred development, the device according to the invention is designed to determine the resonance frequency on the basis of the incoming signal. The advantage of this is that it is possible for the resonance frequency to be determined in respect of the system as a whole on the basis of the incoming signal received by the at least one receiver relating to the entire signal transmission path, i.e. both transmit and receive side, wherein the components usually present anyway can continue to be used.

The device according to the invention can also preferably be developed such that the device is designed to generate an outgoing signal encoded by means of frequency modulation. The advantage of corresponding frequency modulation of the outgoing signal is that it increases reliability in the event of interference and in particular makes the track circuit insensitive to electrical interference caused by harmonics in the traction return current.

In respect of the method, the object of the present invention is to specify a method for operating a device for detecting the occupied or clear state of a track section, said method simplifying device commissioning.

This object is achieved according to the invention by a method for operating a device for detecting the occupied or clear state of a track section, wherein the frequency of an outgoing signal fed into the running rails of the track section is varied, a resonance frequency of the outgoing signal is determined on the basis of the variation of the frequency of the outgoing signal, and the frequency of the outgoing signal is set to the resonance frequency determined.

The advantages of the method according to the invention correspond to those of the device according to the invention, so that in this respect reference is made to the foregoing remarks. The same applies in respect of the preferred developments of the inventive method detailed below with respect to the corresponding preferred developments of the device according to the invention, so that once again reference is made to the respective foregoing remarks.

According to a particularly preferred development, the method according to the invention is designed such that the frequency of the outgoing signal is varied within the range of an operating frequency matched by configuration.

The method according to the invention can preferably also be further developed such that the frequency of the outgoing signal is varied within the range of an operating frequency matched by configuration by means of replaceable tuning units disposed in trackside connection boxes.

According to another particularly preferred embodiment of the method according to the invention, the resonance frequency is determined on the basis of the incoming signal.

The method according to the invention can preferably also be designed such that the outgoing signal is frequency modulation encoded.

BRIEF DESCRIPTION OF THE SEVERAL VIEWS OF THE DRAWING

The invention will now be explained in greater detail with reference to an exemplary embodiment. To explain said exemplary embodiment of the method according to the invention FIGURE schematically illustrates an arrangement comprising a track section and an example of the device according to the invention.

DESCRIPTION OF THE INVENTION

The FIGURE shows a device V for detecting the occupied or clear state of a track section G. The device V has a transmitter S for feeding an outgoing signal $SIG_S$ in the form of an AC voltage into the running rails F of the track section G. The device V additionally comprises a receiver E for receiving an incoming signal $SIG_E$ produced by transmitting the outgoing signal $SIG_S$ via the running rails F of the track section G.

As shown in the FIGURE, an AC voltage of frequency or more specifically operating frequency f1 is provided for the track section G. In order to enable the respective signals to be reliably differentiated, the adjacent track sections are operated using AC voltages of different frequencies f5 and f3 respectively. It will now be assumed that the arrangement shown in the FIGURE is an audio-frequency track circuit having a plurality of frequencies, wherein an AC voltage in the form of an outgoing signal $SIG_S$ in the audio-frequency range is fed into the running rails F of the track section G.

The device V can be disposed, for example, in an interlocking tower of a track system or more specifically a track monitoring system. The advantage of this is that particularly high reliability is achieved, as mechanical stress and climatic effects have less effect on the electronic components of the device V than would be the case if they were installed trackside. This also offers further advantages in respect of the availability and maintenance of the device V, i.e. particularly of the transmitter S and receiver E. The horizontal dash-dotted line in the FIGURE indicates a corresponding separation between the indoor equipment to which the device V is assigned and the outdoor equipment of which the track section G forms part.

As illustrated in the FIGURE, trackside connection boxes GAG1, GAG2 are installed which are used to inject the outgoing signal $SIG_S$ fed in or provided by the transmitter S into the running rails F and/or to read the incoming signal $SIG_E$ transmitted to the receiver E from the running rails F. Said trackside connection boxes GAG1, GAG2 normally contain no active electronic components, but essentially only a resonant circuit for frequency-selective amplification of the signals of a predefined operating frequency fed in or out, i.e. of the outgoing signal $SIG_S$ and of the incoming signal $SIG_E$ of frequency f1 in the case of the track section G shown in the FIGURE.

It should be noted that, depending on the respective implementation and embodiment, the trackside connection boxes GAG1 and GAG2 can also be regarded as part of the device V for detecting the occupied or clear state of the track section G, in which case, unlike in the FIGURE, the device V would therefore also incorporate the trackside connection boxes GAG1 and GAG2.

In the context of the exemplary embodiment described, it shall be assumed that the outgoing signal $SIG_S$ of the transmitter is encoded by means of modulation in the form of frequency modulation. Corresponding encodings are used to increase the reliability in the event of interference, i.e. to reduce the probability of simulation of a correspondingly encoded outgoing signal $SIG_S$ by noise amplitudes, for example. Corresponding noise may be caused on the one hand by external sources, but on the other also by other devices V, i.e. by track circuits disposed in the vicinity, for example. In the case of known track vacancy detection systems based on audio-frequency track circuits, manual adjustment of the trackside tuning units by means of variable capacitors and/or inductors is necessary during commissioning of the system. Here resonance tuning is performed in respect of the outgoing signal $SIG_S$ fed in and possibly also of the incoming signal $SIG_E$ fed out, in order thereby to achieve maximum efficiency of signal feeding into and possibly also out of the respective track section. The disadvantage of the corresponding tuning is that it is extremely time-consuming and therefore costly, as it has to be carried out manually as part of commissioning of the respective track circuit by appropriate personnel using a moreover comparatively expensive calibration instrument.

The illustrated device V for detecting the occupied or clear state of the track section G is now advantageous in that it is designed to vary the frequency of the outgoing signal $SIG_S$, to determine the resonance frequency of the outgoing signal $SIG_S$ and to set the frequency of the outgoing signal $SIG_S$ to the resonance frequency determined. For this purpose the device V has an evaluation device AE in addition to the transmitter S and the receiver E. Said evaluation device enables software-based variation of the frequency of the outgoing signal $SIG_S$, i.e. of the transmit frequency, and allows the achieving of the resonance frequency to be detected on the basis of the incoming signal $SIG_E$ received using the receiver E. This resonance-achieving frequency is set by the evaluation device AE as the working frequency, i.e. as the frequency of the outgoing signal during operational use of the device.

The basic advantage of the device V for detecting the occupied or clear state of a track section is therefore that an automatic track circuit tuning process is possible in respect of the resonance frequency obtaining in the respective individual case. For this purpose the evaluation device AE advantageously implements a software-based control loop which advantageously obviates the need for work to be carried out in the outdoor equipment, i.e. particularly in the area of the trackside connection boxes GAG1 and GAG2, to tune the system to the respective resonance frequency. Instead, the device V can be advantageously matched by configuration merely to different operating frequencies f1, f3, f5 by means of replaceable tuning units disposed in the trackside connection boxes GAG1 and GAG2. On the other hand, the tuning of the system in respect of the respective resonance frequency is performed in each case by varying the frequency of the outgoing signal $SIG_S$ within the range of the operating frequency configured by means of the tuning unit, i.e. f1 in this example.

In accordance with the above comments in connection with the described exemplary embodiment of the inventive device and the corresponding exemplary embodiment of the inventive method, the advantage is achieved, in particular, that time-consuming and therefore costly resonance tuning, e.g. using tuning units with variable inductance and/or capacitance, can be dispensed with for commissioning e.g. audio-frequency track circuits. In addition, further cost savings can be achieved in that comparatively expensive components, e.g. in the form of variable inductors and/or capacitors on the tuning units, can be eliminated. The same applies in respect of mobile calibration instruments for manual resonance tuning trackside, which are likewise no longer required.

The invention claimed is:

1. A device for detecting an occupied state or a clear state of a track section, the device comprising:

a transmitter for feeding an outgoing signal into running rails of the track section;

at least one receiver for receiving an incoming signal produced by transmitting the outgoing signal via the running rails of the track section;

the device programmed to:

vary a frequency of the outgoing signal;

determine a resonance frequency of the outgoing signal; and set the frequency of the outgoing signal to the resonance frequency determined.

2. The device according to claim 1, wherein the device can be matched, by configuration, to different operating frequencies and is configured to vary the frequency of the outgoing signal within a range of a configured operating frequency.

3. The device according to claim 1, wherein the device is configured to determine the resonance frequency on a basis of the incoming signal.

4. The device according to claimed in claim 1, wherein the device is configured to generate the outgoing signal as a frequency-modulation encoded outgoing signal.

5. A device for detecting an occupied state or a clear state of a track section, the device comprising:

a transmitter for feeding an outgoing signal into running rails of the track section;

at least one receiver for receiving an incoming signal produced by transmitting the outgoing signal via the running rails of the track section;

trackside connection boxes;

exchangeable tuning units disposed in said trackside connection boxes, the device can be matched, by configuration, to the different operating frequencies by means of said exchangeable tuning units; and the device being matched, by configuration, to different operating frequencies and configured to vary the frequency of the outgoing signal within a range of a configured operating frequency, the device programmed to:

vary a frequency of the outgoing signal;

determine a resonance frequency of the outgoing signal; and set the frequency of the outgoing signal to the resonance frequency determined.

6. A method for operating a device for detecting an occupied state or a clear state of a track section, the device having a transmitter for feeding an outgoing signal into running rails of the track section and at least one receiver for receiving an incoming signal produced by transmitting the outgoing signal via the running rails of the track section, the method comprises the steps of:

varying a frequency of the outgoing signal fed into the running rails of the track section;

determining a resonance frequency of the outgoing signal on a basis of a variation in the frequency of the outgoing signal; and setting the frequency of the outgoing signal to the resonance frequency determined.

7. The method according to claim 6, which further comprises varying the frequency of the outgoing signal within a range of an operating frequency matched by configuration.

8. The method according to claim 7, wherein the frequency of the outgoing signal is varied by configuration within a range of the operating frequency adapted by configuration by means of replaceable tuning units disposed in trackside connection boxes.

9. The method according to claim 6, which further comprises determining the resonance frequency on a basis of the incoming signal.

10. The method according to claim 6, which further comprises frequency-modulation encoding the outgoing signal.

* * * * *